US006688045B1

(12) United States Patent
Pilcher

(10) Patent No.: US 6,688,045 B1
(45) Date of Patent: Feb. 10, 2004

(54) ENCLOSED RAIN GUTTER

(76) Inventor: Joseph Mitchell Pilcher, 1616 Park Pl., Wichita, KS (US) 67203

( * ) Notice: Subject to any disclaimer, the term of this patent is extended or adjusted under 35 U.S.C. 154(b) by 0 days.

(21) Appl. No.: 10/374,265

(22) Filed: Feb. 25, 2003

Related U.S. Application Data

(63) Continuation of application No. 09/839,673, filed on Apr. 21, 2001, now Pat. No. 6,536,165, which is a continuation of application No. 09/776,032, filed on Feb. 2, 2001.

(60) Provisional application No. 60/180,367, filed on Feb. 4, 2000, provisional application No. 60/199,681, filed on Apr. 21, 2000, and provisional application No. 60/229,717, filed on Aug. 31, 2000.

(51) Int. Cl.[7] ..... E04D 13/064

(52) U.S. Cl. ..... 52/12; 52/11; 52/14; 210/474

(58) Field of Search ..... 52/11–16; 248/48.1, 248/48.2; 210/474, 477

(56) References Cited

U.S. PATENT DOCUMENTS

| | | | | | |
|---|---|---|---|---|---|
| 891,405 | A | * | 6/1908 | Cassens | 210/474 |
| 3,388,555 | A | * | 6/1968 | Foster | 405/119 |
| 4,411,110 | A | * | 10/1983 | Carey | 52/11 |
| 4,435,925 | A | * | 3/1984 | Jefferys | 52/12 |
| 4,616,450 | A | * | 10/1986 | Shouse | 52/12 |
| 4,757,649 | A | * | 7/1988 | Vahldieck | 52/12 |
| 4,796,390 | A | * | 1/1989 | Demartini | 52/12 |
| 5,181,350 | A | * | 1/1993 | Meckstroth | 52/12 |
| 5,216,851 | A | * | 6/1993 | Kuhns | 52/12 |
| 5,305,562 | A | * | 4/1994 | Sapia | 52/12 |
| 5,339,575 | A | * | 8/1994 | Kuhns | 52/12 |
| 5,375,379 | A | * | 12/1994 | Meckstroth | 52/12 |
| 5,383,310 | A | * | 1/1995 | Sapia | 52/12 |
| 5,557,891 | A | * | 9/1996 | Albracht | 52/12 |
| 5,640,809 | A | * | 6/1997 | Iannelli | 52/12 |
| 5,911,659 | A | * | 6/1999 | Serano | 52/12 |
| 6,161,338 | A | * | 12/2000 | Kuhns | 52/12 |

FOREIGN PATENT DOCUMENTS

| | | | | |
|---|---|---|---|---|
| EP | 0889176 | * | 1/1999 | |
| JP | 2-58663 | * | 2/1990 | 52/11 |

* cited by examiner

*Primary Examiner*—Winnie S. Yip
(74) *Attorney, Agent, or Firm*—Robert Blinn

(57) ABSTRACT

The present invention is an enclosed rain gutter for draining water from the surface of a sloped roof and conducting it to a downspout. The invention rain gutter includes a channel that is covered by a mounting flange suitable for insertion under the material covering the roof of a building and a collecting flange connected to the mounting flange by a rounded edge. The collecting flange has openings for delivering water into the channel and features for delivering water to the openings. While the collecting flange features and openings deliver water into the channel, they also exclude debris from entering the channel and in particular they exclude debris might obstruct a downspout.

10 Claims, 7 Drawing Sheets

ENCLOSED RAIN GUTTER

CROSS REFERENCES TO RELATED APPLICATIONS

This application is a continuation-in-part of U.S. Non-Provisional application Ser. No. 09/839,673 filed Apr. 21, 2001 now U.S. Pat No. 6,536,165, which was a continuation in part of U.S. Non-Provisional application Ser. No. 09/776,032 filed Feb. 2, 2001.

This application claims the benefit of U.S. Provisional Patent Application No. 60/180,367 filed Feb. 4, 2000, U.S. Provisional Patent Application No. 60/199,681 filed Apr. 21, 2000 and U.S. Provisional Patent Application No. 60/229,717 filed Aug. 31, 2000.

FIELD OF THE INVENTION

This invention relates to a rain gutter and in particular to an enclosed rain gutter that collects water and rejects debris. The rain gutter of the present invention collects rain water flowing from a roof structure and conducts it to a downspout. The invention rain gutter includes a channel that is covered by a collecting surface. The collecting surface has openings that divert water into the channel by using the property of water that causes it to adhere to a surface. While the collecting surface openings divert water into the channel, they also exclude debris from entering the channel and in particular they exclude debris that would be large enough to obstruct a downspout.

BACKGROUND OF THE INVENTION

Any home owner whose home is located near vegetation knows the frustration of obstructed rain gutters. Removing debris from rain gutters is a time consuming, difficult and often dangerous task. The prior art describes numerous attempts to provide a rain gutter that will not collect debris and become obstructed. Various types of screens and coverings have been marketed for preventing leaves from collecting in rain gutters. Many of these screens or meshes, when placed over conventional rain gutters only serve to provide another even more unsightly means for trapping and collecting debris such as leaves and twigs.

Common prior art rain gutters become obstructed because they are open to falling debris and because the flow of water down the length of the gutter is not managed or controlled. Common prior art rain gutters of the type having a generally flat bottomed, constant and open cross section are an obvious but flawed solution to a problem that seems deceptively simple. A rain gutter need only to perform two functions: 1. collect rain water, and, 2. convey collected rain water to a downspout. A prior art rain gutter is generally flat and open at the top and has an area for collecting water that is many times greater than the actual area of any stream of water that could exit the gutter via a downspout. A prior art rain gutter would overflow long before the cross sectional area of the flow of water into the gutter reached even a small fraction of the total collecting area available. While the vastly oversized, open collecting area of a prior art rain gutter can collect water flowing off of a roof, it is even more effective as a collector of dead leaves and other debris. Most debris falls into the prior art gutter during dry conditions and then is trapped in place during a rain storm when the debris obstructs a downspout. Once a prior art gutter is obstructed, it collects water, overflows and allows adjacent building structures to be water damaged. Prior art rain gutters can also collect snow that after thaw and freeze cycles can accumulate as ice. Moreover, sheets of Ice that form on a sloped roof can slide down into a prior art rain gutter and damage or destroy the gutter.

SUMMARY OF THE INVENTION

An objective of the present invention is to provide a rain gutter that will collect rain water while not collecting any debris that could obstruct water from entering the gutter or obstruct a downspout so that water can not flow out of the gutter. Another objective of the present invention is to provide a rain gutter that is not open to falling debris or snow. Yet another objective of the present invention is to provide a rain gutter that is not open to sheets of ice or other objects that my slide down a roof. Still another objective of the present invention is to provide a rain gutter having a channel that will carry a large flow of water at a relatively constant velocity along its length over a wide range of drainage load conditions so that any small debris that enters the channel is washed away as water is conveyed to a downspout.

The invention rain gutter is designed to be mounted at the lower edge of a sloped, roof of a building adjacent to a vertical surface under the lower edge of the roof. The rain gutter can be fashioned from a continuous sheet of metal. It includes a channel for conveying water to a downspout and a collecting flange for collecting water and diverting it into the channel. Preferably, the channel has a circular cross section that is large enough and extensive enough to carry a substantial flow of water to a downspout. The inside wall of the channel can be mounted to a vertical surface under the edge of the roof or to an eaves under the roof. The collecting flange extends from the outside wall of the channel and over the channel. Preferably, the collecting flange is integral with the outside wall of the channel. The collecting flange can completely cover the channel and can even extend past the inside wall of the channel. The collecting flange can be inserted under the bottom edge of any material covering the roof. Yet, the collecting flange could also be envisioned as a separate cover that can be added to an existing rain gutter.

As rain water flows down from the roof, it encounters the collecting flange and begins to flow as a thin sheet that adheres to the collecting flange surface. The collecting flange has a generally hydrophilic surface and has a pattern of openings that conduct the flow of water into the channel. These openings are sized and arranged to exploit the physical properties of flowing water so that the water is conducted into the channel while all but the smallest debris is not conducted into the channel. One possible pattern of openings includes a pattern of openings having diagonal edges situated above a pattern of collecting slots that are located under gaps between the lower ends of the openings having diagonal edges. The openings having diagonal edges have upper edges that are preferably oriented at an angle of not substantially more than 45° with respect to the direction of the flow of water. When the film of flowing water encounters the diagonal edges, it divides and follows each of the upper edges without flowing into the openings. The water flowing along each diagonal edge of each opening forms into a small, fast moving stream. The collecting slots situated under the gaps between the lower ends of the openings include inwardly turned collecting tabs that divert the small streams of water into the gutter channel. The openings having diagonal edges described above may also be replaced by zones on the surface the collecting flange that are non-hydrophilic, that is zones that have a surface that repels water. Another arrangement of openings does not include collecting slots. With this arrangement, diagonal openings have upper edge that change direction so that the upper edge of the diagonal opening defines a "V" shaped angle at the lower end of the diagonal opening. With this second alternative arrangement, a small, fast moving stream of water is unable to adhere to the collecting flange surface where the upper edge changes direction and will therefore separate from the surface of the collecting flange and discharge down through the lower end of the diagonal opening into the rain gutter channel. Yet another example arrangement of openings includes a series of overlapping obtuse triangles having inwardly bent triangular collecting tabs. Because the lower edge of an inwardly bent collecting tab of this arrangement is slightly angled in relation to the descending contour of the surface, a transverse flow is set up on the inwardly bent tab so that water flowing around an adjacent opening is induced into flowing onto the tab and into the channel. A flowing sheet of water will move along an edge even if that edge is oriented at only a slight angle that is not normal with respect to the contour and the direction of the flow of water.

In addition to the alternative arrangements of openings and non-hydrophilic zones as described above, the collecting flange itself can be alternately further formed to define a small radius folded edge so that it has an upper portion which is secured to the roof of the building and might be called a mounting flange and a lower portion which performs the water collecting function would still be called a collecting flange. With this alternate configuration, the upper portion or mounting flange extends parallel with the slope of the roof, while the lower portion or collecting flange curves inwardly toward the building and then outwardly away from the building toward the outside wall of the channel. Between the upper portion or mounting flange and the lower, collecting flange is a folded edge that has a radius substantially less than one half inch and that preferably has a radius of about 0.10 inch. The various openings and non-hydrophilic zones described above can be positioned in the lower, inwardly curved collecting flange and are positioned so that the portions of the openings where water is collected into the channel are located on the portion of the curved collecting flange that is sloping back toward the outside wall of the channel. With this configuration, a sheet of flowing water accelerates around the curved collecting flange and pulls the flowing sheet of water around the small radius folded edge while any debris is unable to follow the torturous path around the folded edge and is ejected from the system.

With any of the above described arrangements, it is important that any portion of the gutter where water is being diverted into the channel have a surface that is generally hydrophilic. Highly water repellent surfaces would be unsuitable because a flowing sheet of water would separate from such a surface. The inventor has found that thin gauge aluminum having a non-glossy PVC coating provides a suitable surface for the mounting flanges and collecting flanges described above. However, any similarly hydrophilic surface would be suitable for these applications.

With the above described arrangements, dead leaves and other debris do not follow the surface tension induced flow of the water and are pushed over the edge of mounting flange or collecting flange. When the portion of the collecting flange having diagonal openings or collecting slots is inwardly curved, then even small articles of air born materials can not settle into the openings. If the rain gutter channel has a circular cross section, if the circular cross section of the channel is properly adjusted and if the channel is properly sloped toward a downspout, the velocity of flow in the channel, at various volume flow rates would be substantially constant so that even very small debris that might enter the channel would be washed out even at low volume flow rates. A channel having a circular shape has the added advantage of not covering a surface to which it is mounted. A flat sided channel will lay flat against an eaves surface to which it is mounted and allow moisture to attack that surface. A circular channel will allow air to circulate between the channel any surface to which it is mounted.

Accordingly, the rain gutter of the present invention provides a way to collect rain water from a roof structure without collecting debris that can obstruct the gutter system. The invention rain gutter does not collect debris that can obstruct downspouts. Because even the small amount of small debris that enters an invention rain gutter is washed out even at relatively low volume flow rates, the accumulation of debris that plagues prior art rain gutters does not occur. The invention rain gutter collects rain water while rejecting virtually all debris and therefore can function at an optimum level of performance for a very long period of time without any need for maintenance or cleaning.

BRIEF DESCRIPTION OF THE DRAWINGS

The invention and its many attendant objects and advantages will become better understood upon reading the following description of the preferred embodiment in conjunction with the following drawings, wherein.

DETAILED DESCRIPTION

Description of the First Embodiment

Figure 1:
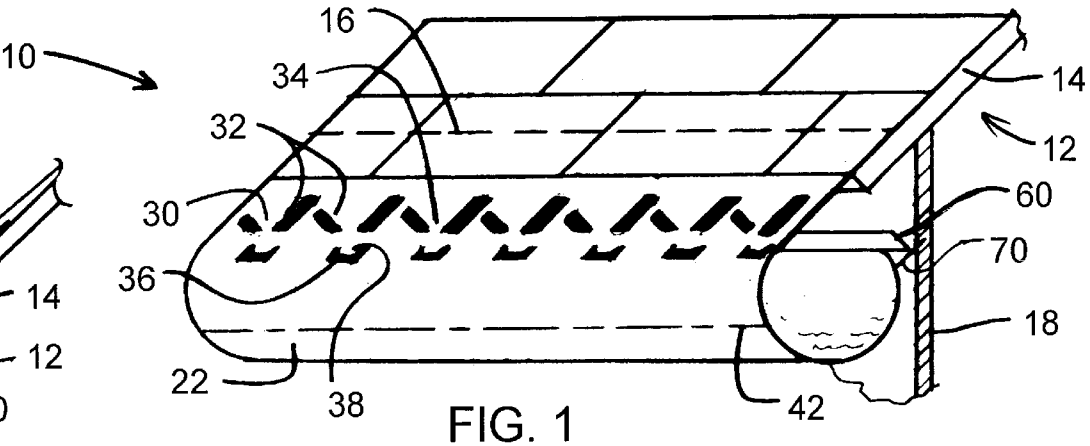
FIG. 1 is a perspective view of a first embodiment of the invention rain gutter shown mounted to a building.

Turning now to the drawings, wherein like reference numerals designate identical or corresponding parts, and more particularly to FIG. 1 thereof, an invention rain gutter 10 is shown mounted to building 12. As can be seen in FIG. 1, building 12 includes a roof 14, shingles 16 and a wall 18. Rain gutter 10 has a channel 22, a collecting flange 30 and a support flange 60 that is supported by clips 70. Channel 22, as shown in FIG. 1, is formed in a circular or polygonal cross section for carrying rain water 24. Collecting flange 30 is generally flat and can be inserted under the bottom row of shingles 16 and fixed to roof 14. Support flange 60 can be bent back from channel 22 at an acute angle to receive clips 70 as shown in FIG. 1.

Collecting flange 30 extends tangent from channel 22 and covers channel 22. Collecting surface 30 of rain gutter 10 has a pattern of diagonal openings 32. Between diagonal openings 32 are gaps 34 that are located above collecting slots 36. It is important that collecting slots 36 be substantially wider than gaps 34. Collecting slots 36 include inwardly bent tabs 38 that depend from the upper edges of the collecting slots. Channel 22, in FIG. 1, is shown to have a plurality of longitudinal creases 42 which define the intersections of the polygonal sides of channel 22. Alternatively, channel 22 can be formed from a rolled section having no creases such as creases 42. Although in this preferred embodiment, a generally circular cross section has been selected for channel 22, any cross section shape can be selected for conveying water. A series of clips 70 can be secured to wall 18 along a graded line so that gutter 10 can be mounted at a slight angle to allow water to flow along channel 22.

Figure 1B:
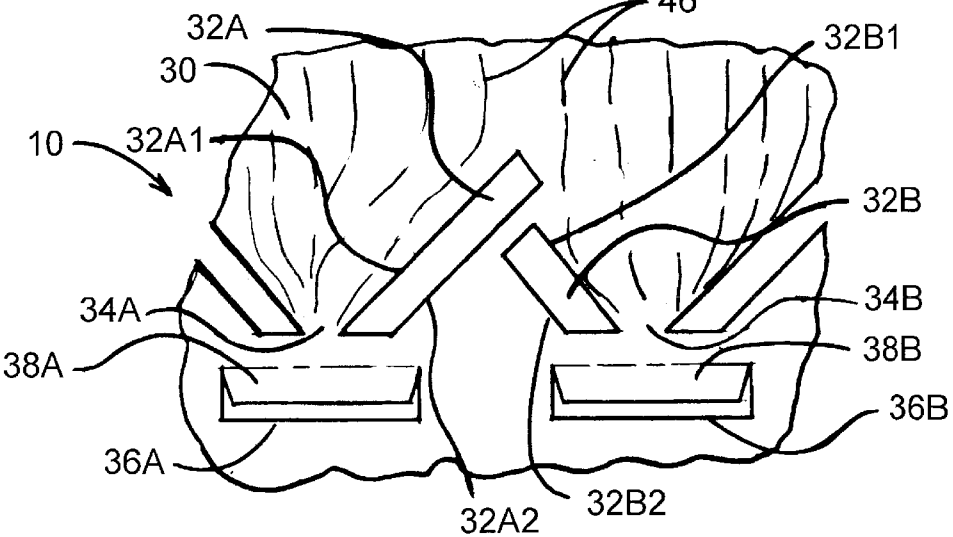
FIG. 1B is a plan view of part of the surface of the first embodiment of the invention rain gutter.
Figure 1A:
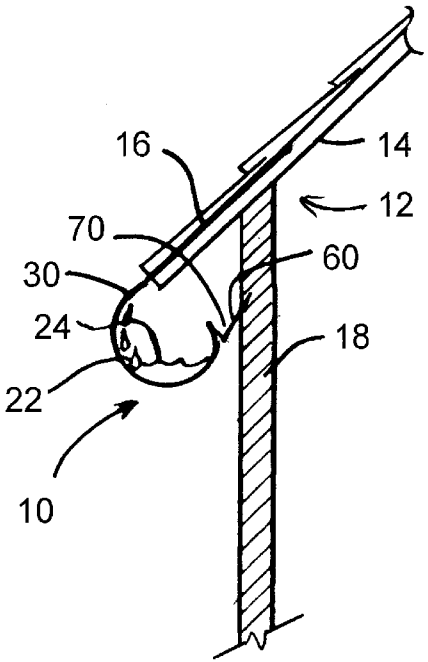
FIG. 1A is a cross sectional view of the first embodiment of the invention rain gutter.

FIG. 1B provides a close up plan view of the surface of collecting flange 30. FIG. 1B also shows pairs of overlapping openings 32, gaps 34A and 34B and collecting slots 36A and 36B having inwardly folding tabs 38A and 38B. Each pair of overlapping openings 32, includes a first diagonal opening 32A and second diagonal opening 32B. First diagonal opening 32A is defined by two parallel edges 32A1 and 32A2. Second diagonal opening 32B is similarly defined by two parallel edges 32B1 and 32B2. Stream lines 46 visualize the flow of water down the surface of collecting flange 30. A sheet of water flowing along stream lines 46 will develop surface tension as it contacts the surface of collecting flange 30. That is, as water flows along stream lines 46 over the surface of collecting flange 30, it will tend to adhere to the surface of collecting flange 30. Consequently, as moving film of water encounters edge 32A1, it will be diverted and run along edge 32A1 toward gap 34A forming a small, fast moving stream of water. However, the flow of water will only be diverted if the angle of attack of the water as it encounters edge 32A1 not significantly greater than 45° and if edge 32A1 is clean and sharp. In the same way, as water flows to edge 32B1, it will be diverted and run along edge 32B1 toward gap 34B, when the angle of attack is not significantly greater than 45° and if edge 32B1 is clean and sharp. Accordingly, slots 32A and 32B do not collect water but rather divert water as they function as barriers as water forms small, fast moving streams along edges 32A1 and 32B1. After the relatively small, fast moving water streams through gaps 34A and 34B, they encounter collecting slots 36A and 36B. Each stream of water continues to adhere to the surface of collecting flange 30 and therefore flows onto the inwardly folding tabs 38A and 38B and then drains into the interior of channel 22.

Collecting flange 30 should be fashioned from a clean piece of painted sheet metal such as thin gauge aluminum having a non-glossy PVC coating. Thin gauge aluminum having a non-glossy PVC coating is generally hydrophilic. A surface that is highly water repellent would be very unsuitable. When flowing on a hydrophilic surface, water tends to adhere to that surface. This is known as the "Coanda Effect". Because of the Coanda Effect, slots 32A and 32B shown in FIG. 1B function as barriers. Water will tend to flow along edges 32A1 and 32B1 even if it has to accelerate to flow through gaps 34A and 34B shown in FIG. 1B. The recurring problem evident in the prior art, where arrangements are proposed for managing thin sheets of flowing water to convey water into a channel while excluding debris, has been the problem of inducing water on a collecting flange type surface to flow normal over an edge into a channel. The present invention solves this problem by using the property of water that causes it to resist flowing as a thin sheet normal to an edge to organize and concentrate the flow of water so that it can flow more easily across an edge and into a channel. Collecting surfaces, and even collecting slots of rain gutters of the present invention feature edges that are at least slightly angled in relation to the direction of flow of the water so that the Coanda Effect can be exploited to facilitate the collection of water while discouraging or even preventing the collection of debris.

The diagonal openings 32A and 32B shown here can be replaced with openings or cut outs having a wide variety of shapes. It is important that these openings have diagonal edges that confront the flow of water at reasonable angles of not more than 70°. Preferably, the diagonal edges should confront the flow of water at angles of not substantially more than 45°. If the force of surface adhesion that holds the water to the surface of collecting flange 30 is overcome by the acceleration force of the water diverting in a changed direction along an edge of a opening, then the water will jump over that edge. Water will be efficiently diverted only at smaller angles. However, if the small angle rule is followed, a large variety of openings can be employed. In fact, decorative shapes could be used to define the shapes of the openings. In this way an effective, closed rain gutter could be provided that is also decorative. Moreover, the volume under collecting flange 30 could be illuminated to create a decorative effect at night. The diagonal openings 32A and 32B could also be replaced by non-hydrophilic zones or inserts having a surface material that has little or no affinity for water such as Teflon®. Such water repelling inserts would cause the flow of water to pile up and divert in much the same way as would the openings described above. Such areas or inserts would have to be wide enough to prevent water from bridging over and flowing over an area or insert. Because water repelling zones would not effect the structural integrity of the collecting flange, such zones could be relatively large and could cover a substantial area of the surface of collecting flange 30.

If the flow of water as represented by stream lines 46 is increased along the surface of collecting flange 30 as shown in FIG. 1B, then the partially diverted stream of water will begin to jump edge 32A1 and bridge across diagonal openings 32A forming a concave trough that is suspended between edges 32A1 and 32A2. The concave trough conveys a stream of water that runs parallel to edges 32A1 and 32A2 toward tab 38A. A similar jumping and bridging process will occur in diagonal opening 32B as the flow of water is increased. As the flow of water is further increased to a very high flow rate, it will overwhelm the capacity of the diagonal openings 32A and 32B and run over the side of gutter 10. However, this very high flow rate is so large that it would overwhelm the capacity of channel 22 as well as the capacity of the downspout fed by channel 22.

The applicant has observed that an article of debris such as a dead leaf or a twig that is carried by the flow of water over the surface of collecting flange 30 does not enter channel 22. The applicant has also observed that even a small piece of debris does not have the ability to adhere to a surface as a stream of water adheres to a surface and therefore even a small piece of debris is separated from the flow of water and therefore does not divert into collecting slots 36A or 36B. Instead, such a foreign object will be ejected over the side of rain gutter 10. A very small foreign object may be diverted into collecting slots 36A or 36B, but such an object would not large enough to obstruct a downspout and therefore would be washed out of the system.

When a circular cross section is selected for channel 22, clips 70 can be secured at varying distances from wall 18 so that channel 22 can be formed into a gradual conical shape having a relatively small cross section at one end and a relatively large cross section at the other end where water is transferred to a downspout. This configuration would allow water to flow at a relatively constant velocity through channel 22 as the volume of flow increased closer to a downspout (not shown). Clips 70 can also be adjusted so that the bottom surface of rain gutter 10 can have a slight slope to further enhance the flow of water. Because rain gutter 10 is generally circular, because its cross section is adjustable as described above and because it can be mounted so that its bottom edge has a slight downward slope towards a downspout, the rain gutter will conduct flow at within in a narrower velocity range for wide range of volumetric flow rates than a prior art, constant cross section, flat bottomed rain gutter. This is because rain gutter 10 provides a gradually increasing cross sectional area as it fills with water. If rain gutter 10 is adjusted into a conical shape, the beginning of the rain gutter can have a smaller cross section where the volumetric flow rate is smaller. In this way, with the circular cross section combined with cross section adjustability, the velocity of the flow can be held relatively constant along the length of the gutter at a given drainage load, and even be held relatively constant along the length of the gutter over a range of drainage loads.

Second Embodiment

Figure 2:
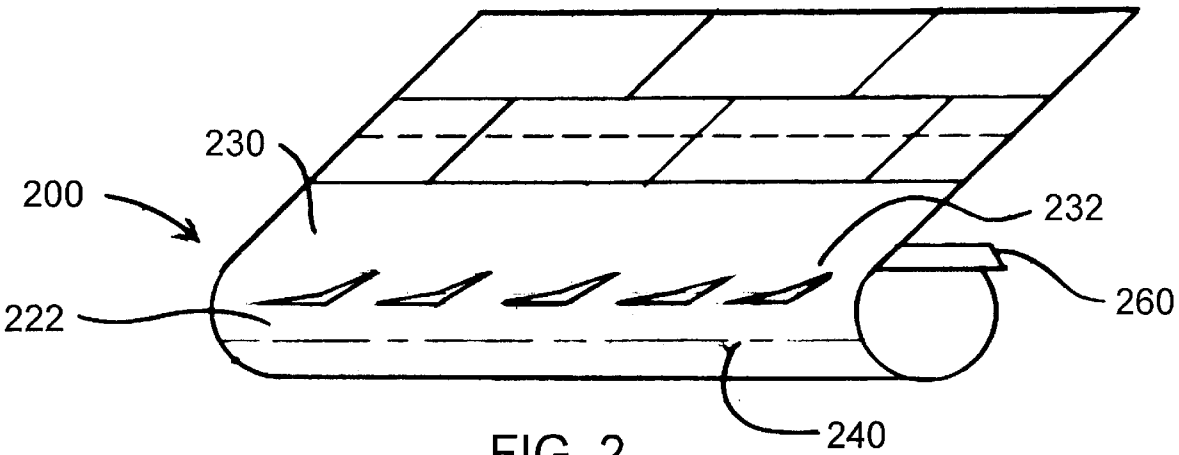
FIG. 2 is a perspective view of a second embodiment of the invention rain gutter shown mounted to a building.
Figure 2A:
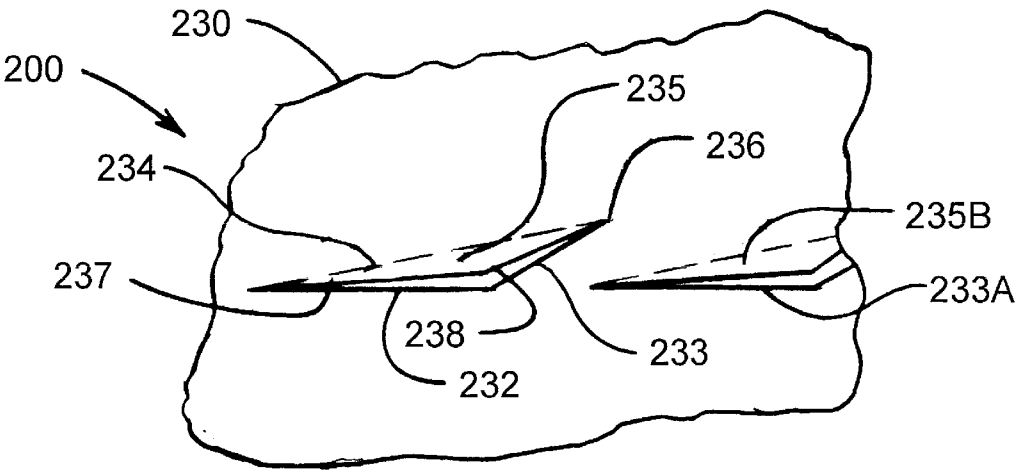
FIG. 2A is a plan view of part of the surface of the second embodiment of the invention rain gutter.

FIG. 2 and FIG. 2A illustrate a second rain gutter 200 which is a second embodiment of the present invention. Much as with the embodiments described above, rain gutter 200 can be fitted under shingles 16. Rain gutter 200 includes a rain gutter channel 222 a support flange 260, a mounting flange 220 and a collecting flange 230. Just as with collecting flange 20 of rain gutter 10, collecting surface 230 of rain gutter 200 has a pattern openings 232. Openings 232 include a diagonal edge 233 and an inwardly bent collecting tab 235. Inwardly bend collecting tab 235 intersects the surface of collecting flange 230 at a folded edge 234. Collecting tab 235 has a lower edge 237 and a collecting tab corner 238. Diagonal edge 233 and folded edge 234 meet at an upper corner 236.

It might appear from casual observation that water flowing upon the surface collecting flange 230 would flow around upper corner 236 an along diagonal edge 233 to escape between the gaps between openings. This, however, is not the case. The flow of water that flows onto bent collecting tab 235B of adjacent opening 232B induces flow so that water flowing near corner 236 is drawn down on to collecting tab 235B. This happens in part because collecting tab lower edge 237 slopes down toward collecting tab corner 238 so that water flowing on the surface of collecting tab 235 will, because of the Coanda Effect, tend to flow toward collecting tab corner 238. Water will tend to flow along an edge even if that edge is not normal to the path of the water by only a small degree. The tendency of the water flowing on the surface of collecting tab 235 to flow along edge 237 sets up a transverse flow of water that induces water flowing around corner 238 to flow down on to collecting tab 235B. By using this a single row of collecting slots having collecting tabs with angle lower edges, it is indeed possible to collect all or almost all of the water flowing over collecting flange 230 with a single row of slots. This can even occur if the collecting slots do not overlap. In this embodiment, as with other embodiments described herein, water tends to follow the path of least resistance and it tends to adhere to itself as it flows. This embodiment, as other embodiments described herein, shares the common strategy of using an angled edge, in this case an angled collecting tab lower edge 237, to organize and direct the flow of water on a collecting surface.

As is the case with the embodiments described above, rain gutter 200 can be installed at a graded angle. Second rain gutter 200, like rain gutter 10, can be mounted to a roof and wall so that it can be adjusted along its length so that the cross sectional area of the channel at one end is larger than at the other end. The mounting flange 260 can also be adjusted so that the bottom surface of rain gutter 200 can have a slight slope to further enhance the flow of water. Because rain gutter 200 is generally circular at the channel portion, because its cross section is adjustable as described above and because it can be mounted so that its bottom surface has a slight downward slope, it too can be adjusted to conduct a flow of water at a relatively constant flow velocity along its length under varying drainage loads as described above with respect to rain gutter 10.

Third Embodiment

Figure 3:
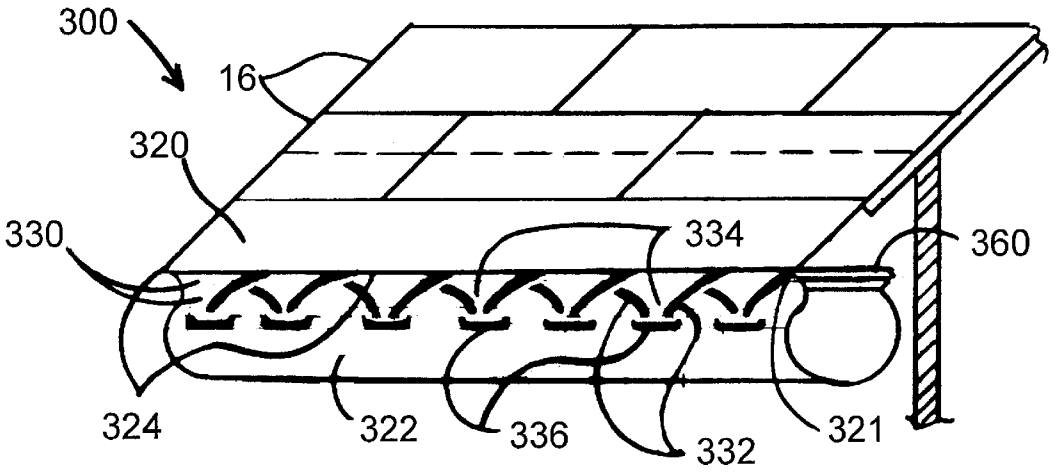
FIG. 3 is a perspective view of a third embodiment of the invention rain gutter shown mounted to a building.
Figure 3A:
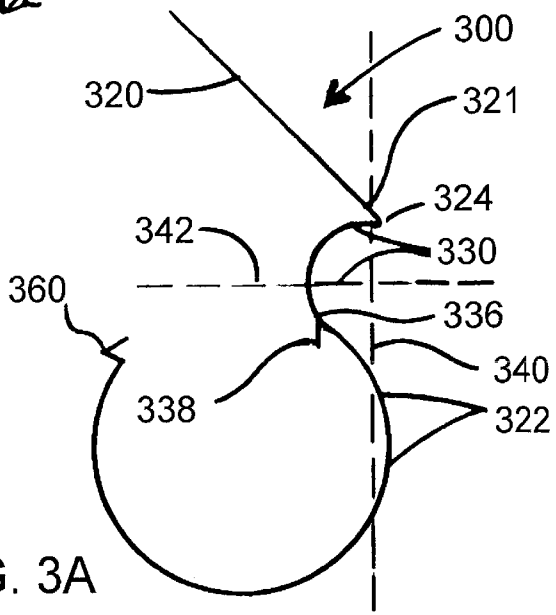
FIG. 3A is a cross sectional view of the third embodiment of the invention rain gutter.

FIG. 3 and FIG. 3A illustrate a third rain gutter 300 which is a third embodiment of the present invention. Much as with the embodiments described above, rain gutter 300 can be fitted under shingles 16. Rain gutter 300 includes a rain gutter channel 322 a support flange 360, a mounting flange 320 and a collecting surface 330. With rain gutter 300, the collecting flange 20 of rain gutter 10, is replaced by an upper mounting flange 320 and a lower collecting surface 330. Mounting flange 320 and collecting surface 330 of rain gutter 300 are separated by a small radius folded edge 324. Collecting surface 330 includes an upper portion that curves toward the building and a lower portion that curves away from the building. Horizontal line 342 shown in FIG. 3A passes through the point where a line tangent to collection surface 330 would also be parallel to plumb line 340. The radius of folded edge 324 should be substantially less than 0.5 inches and preferably about 0.10 inches. Just as with collecting flange 20 of rain gutter 10, collecting surface 330 or rain gutter 300 has a pattern of diagonal openings 332. Between diagonal openings 332 are gaps 334 that are located above collecting slots 336. It is important that collecting slots 336 be located on that portion of the collecting surface that is sloping away from the building and toward the outer wall of channel 322. It is also important that collecting slots 336 be substantially wider than gaps 334. As is more clearly shown in FIG. 3A, collecting tabs 338 fold in from the top edges of collecting slots 336, inwardly and away from collecting surface 330. As can be seen in FIG. 3A, collecting surface 330 can slope inwardly in relation to a plumb line 340 which is defined as a vertical line tangent to folded edge 324. Mounting flange 320 may also include, at its lower edge, a pooling zone 321. Pooling zone, 321 is a slightly indented area. The build up of water in pooling zone 321 tends to force debris past folded edge 324.

As with rain gutter 10, diagonal openings 332 of rain gutter 300 direct the flow of water into gaps 334 where it flows into collecting slots 336 and down into channel 322. It is important that diagonal openings 332 have diagonal edges that confront the flow of water at reasonable angles of not substantially more than 45°. The tendency of water to adhere to a surface is known as the Coanda Effect. As the diagonal edges of diagonal openings 332 converge, the water flowing between those edges flows faster over a smaller area of collecting surface 330. As the stream of water flows down onto collecting tabs 338, because it is by then a small, fast moving stream, it can easily separate from collecting tabs 338 and drain down in to channel 322. If the force of surface adhesion that holds the water to the surface of collecting surface 330 is overcome by the acceleration force of the water diverting in a changed direction along an edge of a opening, then the water will jump over that edge. Water will be efficiently diverted only at smaller angles. However, if the small angle rule is followed, a large variety of openings can be employed.

Figure 3B:
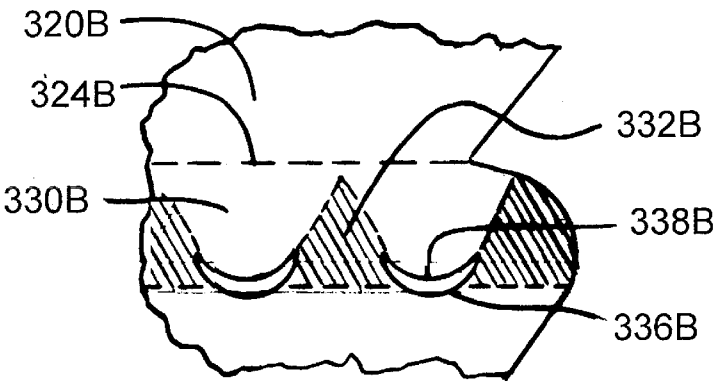
FIG. 3B a plan view of part of the surface of an alternate configuration of the third embodiment of the invention rain gutter.

FIG. 3B illustrates that the diagonal openings 332 could be replaced by water repelling zones 332B that have little or no affinity for water. Such water repelling zones could be fashioned by coating the indicated surface with a material such as Teflon®. Such a water repelling zone would cause the flow of water to divert in much the same way as would openings 332 in FIG. 3. Preferably, as shown in FIG. 3B, water repelling zones should be wide enough to prevent water from bridging over a zone to escape. Water repelling zones 332B could be superior to diagonal openings because they would not be able to catch debris. The use of water repelling zones 332B shown in FIG. 3B to redirect the flow of water on collecting surface 330B illustrates a key aspect of the present invention. Diagonal opening 332 in the hydrophilic collecting surface 330 of FIG. 3 functions in the same way as a zone that has a water repelling surface. Because of this, a diagonal opening such as diagonal opening 332 of FIG. 3 may be considered as a "non-hydrophilic zone", just as a zone having a water repellent coating may also be considered as a "non-hydrophilic zone". What is key to the present invention is that the boundary between the hydrophilic surface of the collecting surface and a non-hydrophilic zone can be oriented with respect to the direction of the flow of water at a non-normal angle so that the flow of water will change direction when it encounters the boundary. Collecting slots 336B shown in FIG. 3B have a curved shape so that the bottom edges of inwardly bent tabs 338B also have a curved shape. The curved bottom edges of inwardly bent tabs 338B cause water to move down the curved edges toward the center of each tab to further induce the flow of water into collecting slots 336B. Collecting slots 336B illustrate that a collecting slot may have other than a horizontal or rectangular shape and thereby function more effectively to collect water.

It may appear from casual observation that a film of water will not flow around folded edge 324. This might be true if the film of water flowing down collecting surface 330 were eventually confronted by a series of normal edges, and this would be especially true if those normal edges were confronted near or above line 342. However, if water is accelerated and effectively pulled across collecting surface 330 as it is when it encounters diagonal openings 332, then water flows easily around folded edge 324. Accordingly, with collecting surface 330, a thin film of water can be drawn around folded edge 324 while debris that can not negotiate folded edge 324 is easily ejected. The inventor has found that a thin film of water will flow more easily around folded edge 324 if collecting surface 330 especially in the area of folded edge 324 has surface texture features that are generally normal to folded edge 324. A hydrophilic PVC coated surface could for example have a surface grain that is generally perpendicular to folded edge 324. When the surface of collecting surface 330 has this type of texture with this type of orientation, the flow of water around edge 324 is established more rapidly than when there is no surface texture.

As is the case with rain gutter 10, rain gutter 300 can be installed at a graded angle. Third rain gutter 300, like rain gutter 10, can be mounted to a roof and wall so that it can be adjusted along its length so that the cross sectional area of the channel at one end is larger than at the other end. The mounting flange 360 can also be adjusted so that the bottom surface of rain gutter 300 can have a slight slope to further enhance the flow of water. Because rain gutter 300 is generally circular at the channel portion, because its cross section is adjustable as described above and because it can be mounted so that its bottom surface has a slight downward slope, it too can be adjusted to conduct a flow of water at a relatively constant flow velocity along its length under varying drainage loads as described above with respect to rain gutter 10. It may appear from casual observation that a sheet of water would not flow around.

Rain gutter 300 is able to eject almost all debris from the system because rain a film of water can easily navigate folded angular edge 324 but the debris absolutely cannot make the sharp turn at folded angular edge 324 and is completely ejected from the system. Rain Gutter 10 will reject most debris, but rain gutter 300 will simply not allow any debris except very small debris to enter channel 322.

Fourth Embodiment

Figure 4:
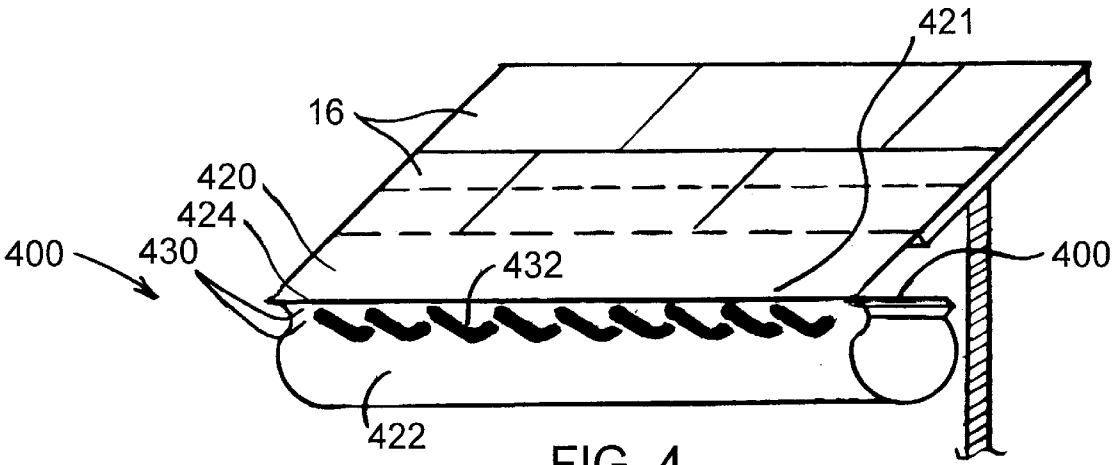
FIG. 4 is a perspective view of a fourth embodiment of the invention rain gutter shown mounted to a building.
Figure 4B:
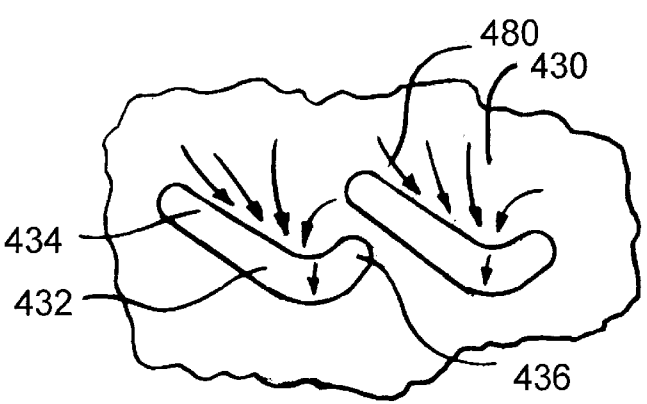
FIG. 4B is a plan view of part of the surface of the fourth embodiment of the invention rain gutter.
Figure 4A:
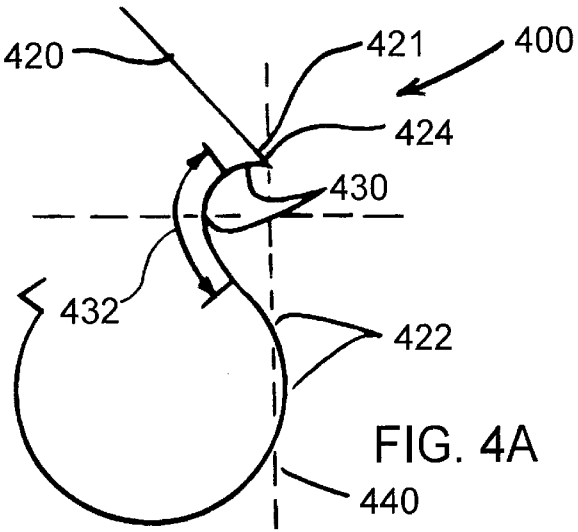
FIG. 4A is a cross sectional view of the fourth embodiment of the invention rain gutter.

FIG. 4, FIG. 4A and FIG. 4B illustrate rain gutter 400, which is a fourth embodiment of the present invention. Much as with the embodiments described above, rain gutter 400 can be fitted under shingles 16 and includes a mounting flange 420, a collecting surface 430, a channel 422, and a support flange 460. As can be seen in FIG. 4 and FIG. 4A, collecting surface 430 curves inwardly in relation to a plumb line 440 under a folded, angular edge 424. Accordingly, collecting surface 430 is located under mounting flange 420 and above channel 422. Arranged on collecting surface 430 are diagonal openings 432. A pooling area 421 runs just above and parallel to folded edge 424.

Diagonal openings 432 are shown in greater detail in FIG. 4B. Diagonal openings 432 include a long leg 434 and a short leg 436 that intersect at an angle. Diagonal openings 432 are arranged so that each long leg 434 substantially overlaps the adjacent short leg 436. The vertical position of diagonal openings 432 is illustrated in FIG. 4A. A flow of water 480 shown in FIG. 4B travels along the top edge of long leg 434 and even up a portion of the top edge of short leg 436 for a short distance against the force of gravity. However, flow of water 480 is overcome by gravity and loses adhesion with the upper edge of opening 432 where the top edges of long leg 434 and short leg 436 meet and drains into channel 422 of rain gutter 400. This loss of adhesion and flow into channel 422 occurs because flow of water 480 can only flow down into channel 422. Because diagonal openings 432 are positioned on the surface of collecting surface 430 so that the lower edge of opening 422 is below horizontal line 442 and closer to plum line 440, flow of water 480 can easily pass down into channel 422. As flow of water 480 is increased, the more energetic component of flow from long portion 432 causes the flow to assume a direction more parallel with long portion 434. Diagonal openings 432 can be adjusted in size and width so that their cumulative capacity is substantially the same as the capacity of cannel 422.

As is the case with the embodiments described above, rain gutter 400 can also be installed at a graded angle and installed to vary the cross sectional area of its channel along its length so that it too can be adjusted to conduct a flow of water at a relatively constant flow velocity along its length under varying drainage loads.

Rain gutter 400 is able to eject almost all debris from the system because a film of water can easily navigate folded angular edge 424 but the debris cannot make the sharp turn at folded angular edge 424 and is completely ejected from the system. Because with rain gutter 400, diagonal openings 432 are covered by mounting flange 420, even falling debris can not enter channel 422. Rain gutter 400 is easier to produce than the rain gutters described above because collecting surface 430 has fewer openings and no inwardly bent collecting tabs.

Fifth Embodiment

Figures 5, 5A:
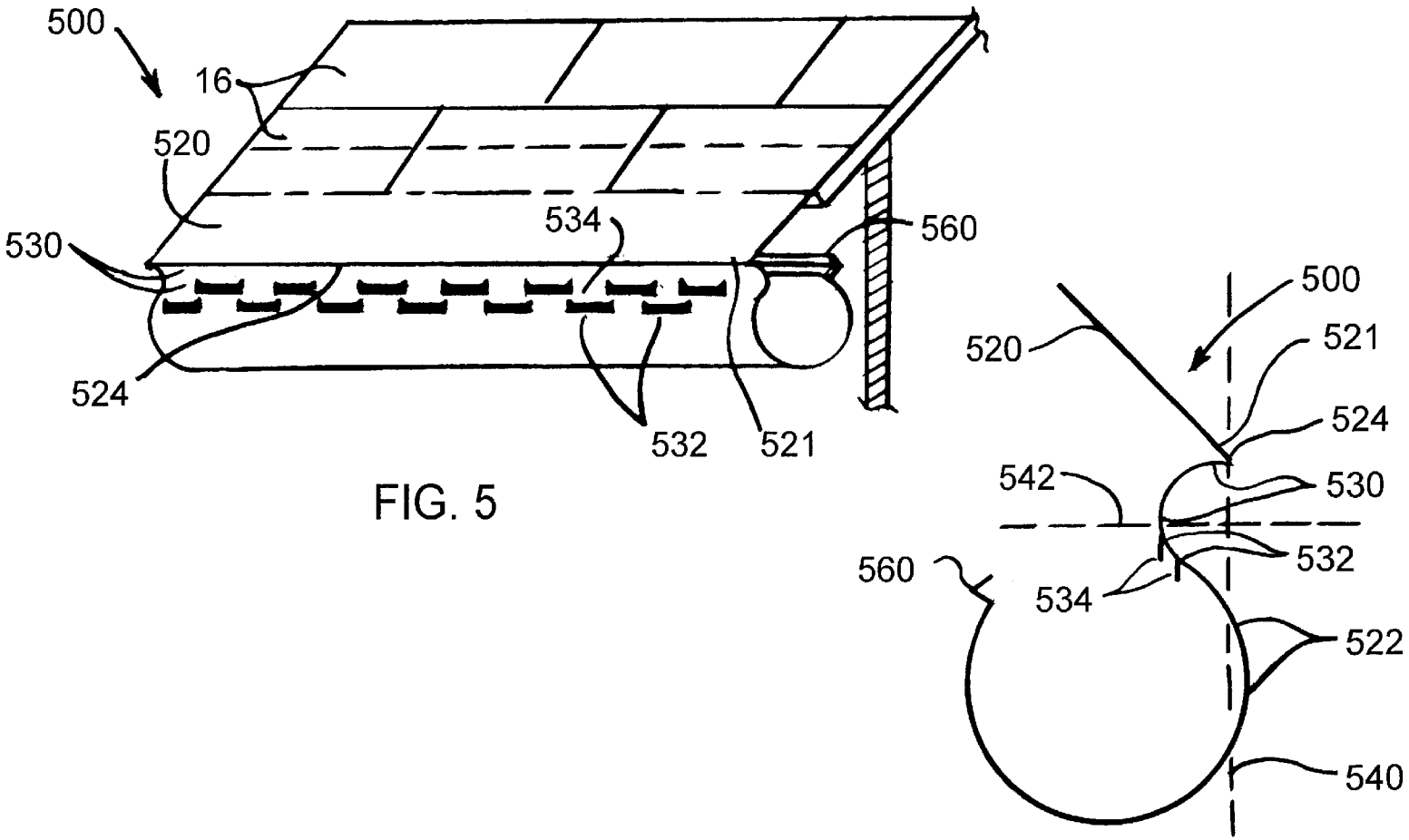
FIG. 5 is a perspective view of a fifth embodiment of the invention rain gutter shown mounted to a building.
FIG. 5A is a cross sectional view of the fifth embodiment of the invention rain gutter.

FIG. 5, and FIG. 5A illustrate rain gutter 500, which is a fifth embodiment of the present invention. Much as with the embodiments described above, rain gutter 500 can be fitted under shingles 16 and includes a mounting flange 520, a collecting surface 530, a channel 522, and a support flange 560. As can be seen in FIG. 5 and FIG. 5A, the collecting surface 530 curves inwardly under a folded, angular edge 524 in relation to a plumb line 540. Collecting surface 530 is located under mounting flange 520 and above channel 522. Pooling area 521 runs just above and parallel to folded edge 524. Arranged on the surface of collecting surface 530 are overlapping collecting slots 532.

Collecting slots 532, as shown in FIG. 5 and FIG. 5A, are arranged on collecting surface 530 in at least two staggered rows so that water flowing on collecting surface 530 is captured by one of the slots. Starting at the top edge of each collecting slot 532 is an inwardly bent tab 534 that acts to direct water down into channel 522. Collecting slots 532 can be adjusted in size and width so that their cumulative capacity is substantially the same as the capacity of cannel 522.

As is the case with the embodiments described above, rain gutter 500 can also be installed at a graded angle and installed to vary the cross sectional area of its channel along its length so that it too can be adjusted to conduct a flow of water at a relatively constant flow velocity along its length under varying drainage loads.

Rain gutter 500 is able to eject almost all debris from the system because rain a film of water can easily navigate folded angular edge 524 but the debris absolutely cannot make the sharp turn at folded angular edge 524 and is completely ejected from the system. Because collecting slots 532 are covered by mounting flange 520, even falling debris can not invade channel 522.

Sixth Embodiment

Figure 6A:
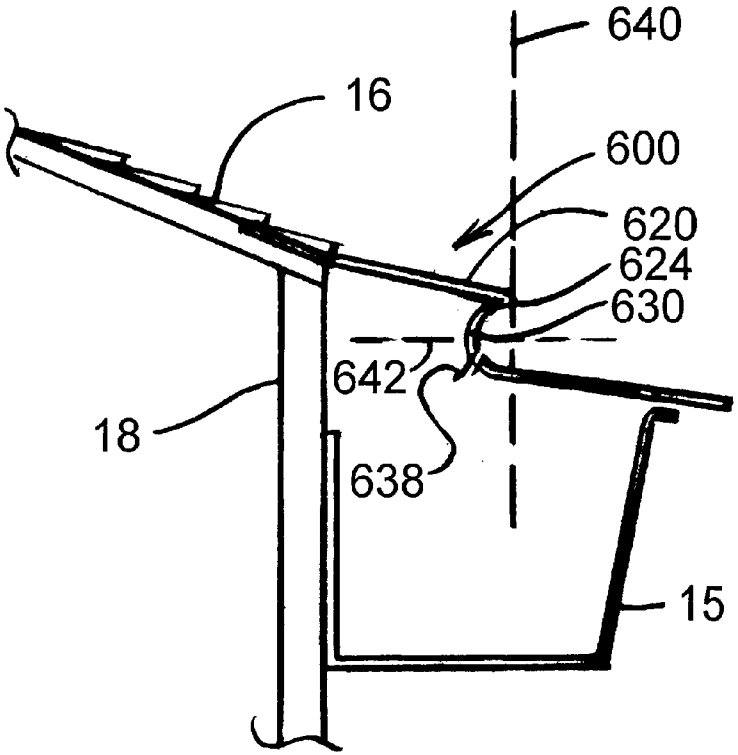
FIG. 6A is a cross sectional side view of the sixth embodiment of the invention rain gutter.
Figure 6:
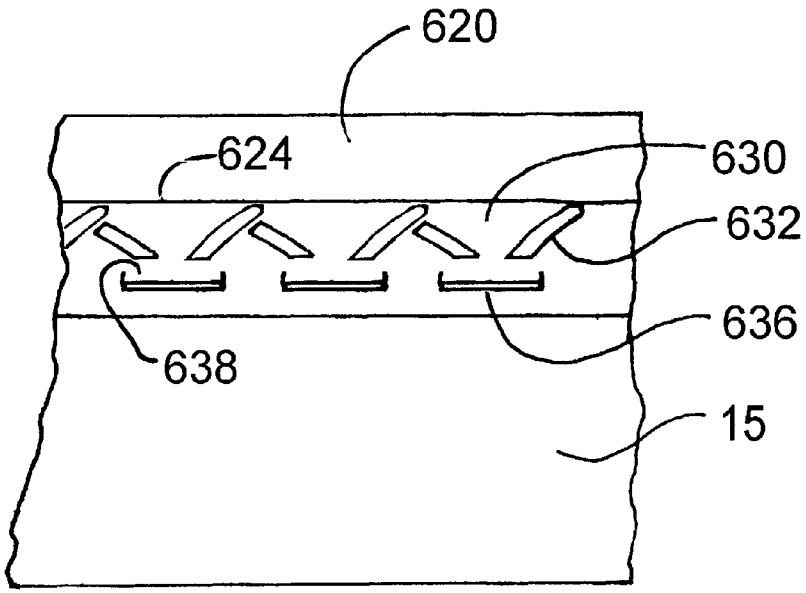
FIG. 6 is a front view of a sixth embodiment of the invention rain gutter shown mounted to a building.

FIG. 6, and FIG. 6A illustrate rain gutter cover 600, which is a sixth embodiment of the present invention. Rain gutter cover 600 is not a complete gutter system but rather is a cover that can be placed over a conventional gutter 15. Rain gutter cover 600 illustrates that the present invention can be applied to a cover that will convert a conventional rain gutter into one having the elements of the present invention. As shown in FIG. 6A, gutter cover 600 can be fitted under shingles 16 and includes a mounting flange 620 and a collecting surface 630. As can be seen in FIG. 6 and FIG. 6A, the collecting surface 630 curves inwardly under a folded, angular edge 624 in relation to a plumb line 640. Collecting surface 630 is located under mounting flange 620 and above conventional gutter 15. Arranged on the surface of collecting surface 630 are diagonal openings 632 and collecting slots 636.

Diagonal openings 632 and collecting slots 636, as shown in FIG. 6 and FIG. 6A, are arranged on collecting surface 630 so that water flowing on collecting surface 630 is diverted by diagonal openings 632 and then captured by collecting slots 636. Starting at the top edge of each collecting slot 632 is an inwardly bent tab 638 that acts to direct water down into above conventional gutter 15. Collecting slots 636 are located below horizontal line 642 which crosses through a point on collecting surface 630 where a line tangent to surface 630 would be parallel to plumb line 640. That is, collecting slots 636 should be located on that portion of the collecting surface that is curving back toward plumb line 640 and away from the building.

Rain gutter cover 600 is able to eject almost all debris from the system because rain a film of water can easily navigate folded angular edge 624 but the debris absolutely cannot make the sharp turn at folded angular edge 624 and is completely ejected from the system. Because collecting slots 632 are covered by mounting flange 620, even falling debris can not invade conventional gutter 15.

It should be noted that it is possible to place any combination of the diverting and collecting openings present in rain gutters 10 and 200 shown in FIG. 1 and FIG. 2 respectively on an inwardly curved collecting surface such as surface 430 of rain gutter 400 shown in FIG. 4 or surface 530 of rain gutter 500 shown in FIG. 5. It should also be noted that any one of the configurations shown can be adapted to define a cover that can be added to a conventional gutter as is the case with gutter cover 600 shown in FIG. 6 and FIG. 6A.

Seventh Embodiment

Figure 7:
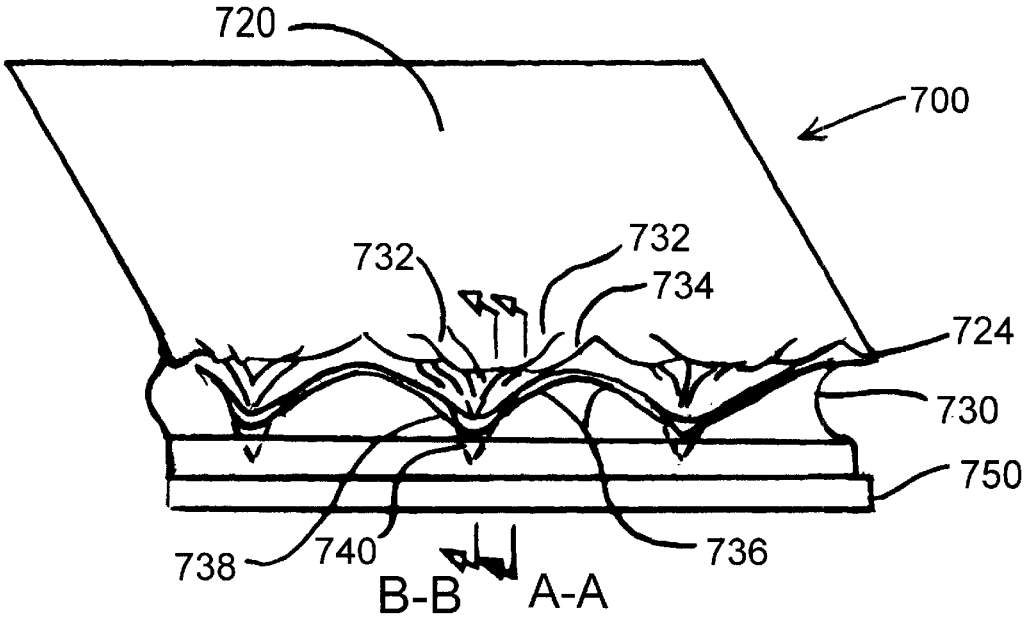
FIG. 7 is a perspective view of a rain gutter cover that is a seventh embodiment of present invention.

FIG. 7 illustrates rain gutter cover 700, which is a seventh embodiment of the present invention. Rain gutter cover 700 is not a complete gutter system but rather it is a cover that can be placed over a conventional gutter such as gutter 15 shown in FIG. 6. Even though rain gutter cover 700 is not a complete gutter, the concepts of the design of gutter cover 700 can easily be applied to a complete, enclosed gutter. Rain gutter cover 700 embodies an approach to diverting water across a surface towards a water collecting opening that is somewhat different than the approach used in the embodiments described above. Rain gutter cover 700 is fashioned so that it has a very contoured surface. The surfaces of Rain gutter cover 700 are not flat along contours of constant elevation as they tend to be with the embodiments described above. The channeling of rain water with rain gutter cover 700 is accomplished by using edges that are angled in relation to normal direction of the flow of water, but those angled edges do not result from cut outs in thin sheets of material. With rain gutter cover 700, the angled or sloped edges are present at the edges of features that project out in relation to the adjacent surface of the rain gutter. In rain gutter cover 700, these features include curved, channeling features 732 and 734 that originate at the lower edge of mounting flange 720 and channeling feature 736 that curves between collecting openings in collecting flange 730. Water follows the edges of the curved channeling features 732, 734 and 736 in much the same way and for some of the same physical reasons that water will follow the edge of a cut out in a sheet of material. However, these curved, channeling features 732, 734 and 736 do not present a means for collecting debris. Although wet debris may adhere to channeling features 732, 734 and 736, when it does so, water can still flow under the wet debris. When the debris dries it will fall away from gutter cover 700. Channeling features 732, 734 and 736 can be used to direct the flow of rain water to surprisingly small openings that are virtually impervious to the entry of debris.

Rain gutter cover 700 includes a mounting flange 720, a rounded edge 724, a collecting flange 730 and a mounting step 750. Mounting step 750 includes two upright walls 750A and 750B and a generally horizontal wall 750C. Mounting step 750 makes it possible to easily install rain gutter cover 700 where existing gutters have varying widths or locations in relation to the roof line of the building. Originating just above rounded edge 724 on mounting flange 720 and sloping down across collecting flange 730 are two channeling features 732 and 734. Channeling feature 736 curves along the surface of collecting flange 730 between collecting openings 738. These channeling features and collecting opening 738 are symmetrical about plane B—B in FIG. 7. Their function is to divide up a flowing film of water that flows down mounting flange 720 and organize it into separate streams that flow across collecting flange 730 and down into collecting opening 738. Although in this example three channeling features are shown, it may be possible to direct substantially all of the water flowing as a film on mounting flange 720 into opening 738 with one or a combination of two of the three channeling features shown.

Figure 7A:
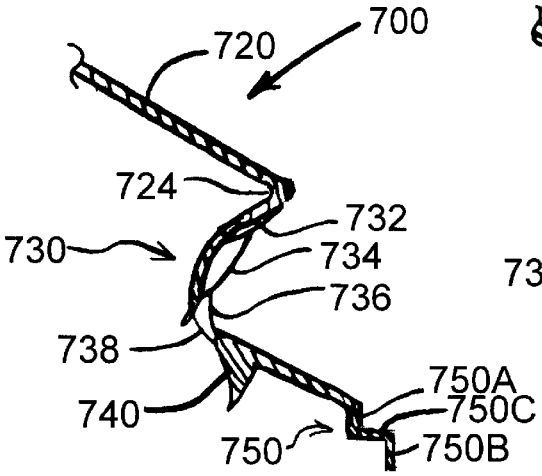
FIG. 7A is a sectional view of the rain gutter cover of the seventh embodiment takent from plane A—A of FIG. 7.
Figure 7B:
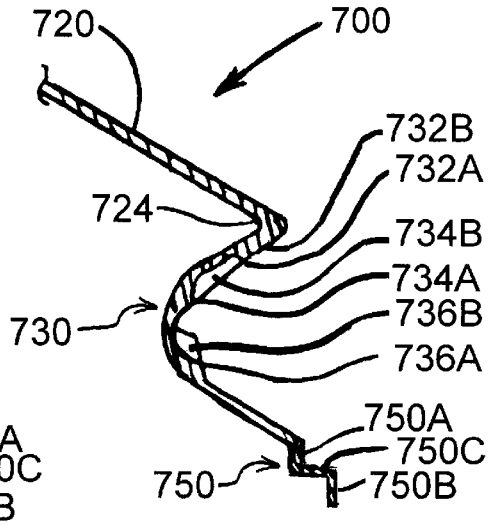
FIG. 7B is a sectional view of the rain gutter cover of the seventh embodiment takent from plane B—B of FIG. 7.

As can be seen in more detail in FIG. 7A and FIG. 7B, first channeling feature 732, second channeling feature 734 and third channeling feature 736 are raised, curved features having curved cross sections. As shown in FIG. 7B, channeling feature 732 includes two opposite edges 732A and a channeling surface 732B that extends to those edges. Channeling surface 732B can be generally flat along a contour of constant elevation or could, in some areas, have turned up edges as shown in FIG. 7A. Channeling feature 734 includes a turned up edge 734A and channeling surface 734B that curves inwardly to provide a reduction in profile so that edge 732A of channeling feature 732 can be formed. Similarly, channeling feature 736 includes an edge 736A and channeling surface 736B which also curves inwardly to causing a reduction of the thickness of collecting flange 730 so that edge 734A of channeling feature 734 can be formed.

Channeling features 732 and 734 wrap around rounded edge 724 and taper out at the lower end of mounting flange 720. Because the function of channeling features 732 and 734 is to organize a flowing film of water into streams of water that flow toward and eventually into collecting opening 738, it is important to not extend channeling features 732 and 734 a significant distance up on to mounting flange 720. If channeling features 732 and 734 are extended a significant distance up on to mounting flange 720, then fast moving streams of water will be organized that can not flow around rounded edge 724 without separating from rounded edge 724. The centripetal force of such a stream of water will overcome its adhesion to the surface which will cause it to separate at rounded edge 724. However, if rounded edge 724 is given a relatively large radius, it is then possible to extend channeling features 732 and 734 up on to mounting flange 720 by a greater distance because the centripetal force acting on the stream decreases as the radius of rounded edge 724 increases.

As can be seen in FIG. 7A, channeling features 732, 734 and 736 converge above collecting opening 738. A drain feature 740 is located on the underside of gutter cover 720 just below collecting opening 738. Drain feature 740 is shaped to release a flow of water down into a gutter channel. Drain feature 740 is useful for a gutter cover as shown in FIG. 7 because if water adheres to the underside of gutter cover 700, it will flow down to and possibly over the edge of the gutter that it is covering. Drain feature 740 would be less useful in a complete gutter as opposed to a gutter cover but would still be useful for organizing and pulling the stream of water down into the gutter channel.

Although gutter cover 700 has been illustrated with an inwardly turned collecting flange 730, channeling features such as channeling features 732, 734 and 736 and collecting openings such as collecting opening 738 could be incorporated into an enclosed rain gutter such as rain gutter 10 shown in FIG. 1. The resulting rain gutter using the water channeling concepts of rain gutter cover 700 would be made from some moldable material such as plastic. Such a rain gutter would have many of the same advantages as a gutter or gutter cover having an inwardly turned collecting surface.

Gutter cover 700 provides significant advantages. It is almost impossible for debris to follow the torturous path from mounting flange 720 into collecting opening 738. Pine needles are a significant problem in many areas of the United States. Although pine needles tend to orient in direction that is normal to the direction of a moving film of water and tend to cling to edges and then collect in the slots and openings of prior art enclosed gutters, pine needles can not adhere to the edges of this contoured gutter cover. Pine needles will separate at rounded edge 724 because it has an uneven, almost stepped surface and be rejected by cover 700. Rain gutter cover 700 is almost perfectly adapted to collect only rain water and reject virtually any type of debris. Moreover, rain gutter cover 700 is capable of collecting a flow of rain water that would be large enough to overwhelm a downspout. As noted above, a gutter system has too much collecting capacity if that collecting capacity is greater than the downspout capacity.

The skilled reader will find a common thread in most of the embodiments described above. Water will tend to flow around a curved surface and adhere to an overhanging surface because of the surface tension property of water. Because of the Coanda effect, water will tend to flow along an edge that is oriented against a grade. By using the property of surface tension to move water upon overhanging surfaces and the Coanda effect to direct water along edges that are angled in relation to the grade of a surface, it is possible to devise water collecting gutters that will draw in rain water but that will reject debris that would obstruct a rain gutter.

In view of the numerous embodiments described above, numerous modifications and variations of the preferred embodiments disclosed herein are possible and will occur to those skilled in the art in view of this description. For example, many functions and advantages are described for the preferred embodiments, but in some uses of the invention, not all of these functions and advantages would be needed. Therefore, I contemplate the use of the invention using fewer than the complete set of noted functions and advantages. Moreover, several species and embodiments of the invention are disclosed herein, but not all are specifically claimed, although all are covered by generic claims. Nevertheless, it is my intention that each and every one of these species and embodiments, and the equivalents thereof, be encompassed and protected within the scope of the following claims, and no dedication to the public is intended by virtue of the lack of claims specific to any individual species. Accordingly, it is expressly to be understood that these modifications and variations, and the equivalents thereof, are to be considered within the spirit and scope of the invention as defined by the following claims, wherein, I claim:

What is claimed is:

1. A rain gutter cover for covering a gutter of the type having a channel including an inside wall that is mounted adjacent to a building and an outside wall, the cover comprising;

a mounting flange and a collecting flange, the mounting flange having an upper edge suitable for inserting under materials that cover the roof of the building, the mounting flange connected to the collecting flange by a rounded edge and the collecting flange having an inwardly curved surface that curves away from the rounded edge, under the mounting flange and toward the building and then out away from the building to extend past outside wall of the channel of the gutter, an upper portion of the inwardly curved surface of the collecting flange receiving rain water from the surface of the roof, the inwardly curved surfaced of collecting flange having collecting openings for receiving the flow of rain water into the channel and the upper portion of the inwardly curved surface of the collecting flange having raised features for receiving the rain water dividing it into streams and directing the streams into the collecting openings.

2. The rain gutter cover of claim 1 wherein the raised features for dividing the rain water into streams and directing those streams into the collecting openings are channeling features that curve across the surface of the collecting flange and include channeling surfaces and channeling edges.

3. The rain gutter cover of claim 1 wherein the collecting openings include drain features shaped to receive streams of water from the raised features and releasing the water into the gutter channel.

4. The rain gutter cover of claim 1 wherein the collecting flange includes at least one mounting step disposed at its lower edge including two upright walls connected by a generally horizontal wall.

5. The rain gutter cover of claim 1 wherein (a) the raised features for dividing the rain water into streams and directing those streams into the collecting openings are channeling features that curve across the surface of the collecting flange and include channeling surfaces and channeling edges, and (b) the collecting openings include drain features shaped to receive streams of water from the raised features and releasing the water into the gutter channel.

6. A rain gutter for collecting rain water flowing from a roof of a building for collecting rain water while rejecting debris and for conveying the rain water to a down spout, the rain gutter comprising;

(a) a channel for conveying a stream of water having an inside wall positioned next to the building and an outside wall that is positioned away from the building, and, (b) a rain gutter over comprising flange and a collecting flange, the mounting flange having an upper edge suitable for insertion under material covering the roof of the building, the mounting flange connected to the collecting flange by a rounded edge and the collecting flange curving away from the rounded edge toward the building and then away from the building in a downwardly sloped manner such that it encloses the channel, the collecting flange including collecting openings for receiving water into the channel and raised channeling features for dividing the flow of water into streams and directing the resulting streams into the collecting openings.

7. The rain gutter of claim 6 wherein the raised channeling features are disposed in a generally symmetrical repeating pattern in relation to the collecting openings and such that the raised channeling features sweep across the collecting surface toward the collecting openings.

8. The rain gutter of claim 6 wherein the raised channeling features include at least two substantially parallel curved channeling features including a first curved channeling feature and a second channeling feature, the first and second channeling features positioned so that a substantial portion of the water that flows over and around the first channeling feature is captured and redirected by the second channeling feature.

9. The rain gutter of claim 6 wherein the raised channeling features include at least two substantially parallel curved channeling features including a first curved channeling feature and a second channeling feature, the first and second channeling features positioned so that a substantial portion of the water that flows over and around the first channeling feature is caught and redirected by the second channeling feature and wherein the collecting opening further comprises a drain feature that is located below the collecting opening and on the under side of the collecting flange for directing the flow of water into the gutter channel.

10. The rain gutter of claim 6, wherein, (a) the raised channeling features include at least two substantially parallel curved channeling features including a first curved channeling feature and a second channeling feature, the first and second channeling features positioned so that water that flows over and around the first channeling feature is caught and redirected by the second channeling feature, and (b) the collecting opening further comprises a drain feature that is located below the collecting opening and on the under side of the collecting flange for directing the flow of water into the gutter channel.

* * * * *